US009393711B2

(12) United States Patent
Myrhum, Jr. et al.

(10) Patent No.: US 9,393,711 B2
(45) Date of Patent: Jul. 19, 2016

(54) HAND-HELD KNOCKOUT PUNCH DRIVER

(75) Inventors: James O. Myrhum, Jr., West Bend, WI (US); Troy C. Thorson, Waukesha, WI (US); Koon For Chung, Hong Kong (CN)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 1027 days.

(21) Appl. No.: 13/444,772

(22) Filed: Apr. 11, 2012

(65) Prior Publication Data

US 2012/0255184 A1 Oct. 11, 2012

Related U.S. Application Data

(60) Provisional application No. 61/474,156, filed on Apr. 11, 2011.

(51) Int. Cl.
*B26F 1/36* (2006.01)
*B26F 1/38* (2006.01)

(52) U.S. Cl.
CPC .... *B26F 1/38* (2013.01); *B26F 1/36* (2013.01)

(58) Field of Classification Search
CPC .... B26F 1/00; B26F 1/386; B26F 2001/4436; B26F 2210/16; B26F 1/36
USPC ..... 173/201, 117, 122, 126, 128, 129, 130, 173/131, 132, 210, 29, 46, 200; 30/362, 30/367, 358, 360; 83/679, 681, 686, 83/698.21, 698.91
See application file for complete search history.

(56) References Cited

U.S. PATENT DOCUMENTS

| | | | | | |
|---|---|---|---|---|---|
| 1,151,032 | A | | 8/1915 | Moore | |
| 1,279,362 | A | | 9/1918 | Krueger | |
| 1,583,715 | A | | 5/1926 | Houston | |
| 1,721,007 | A | | 7/1929 | Doherty et al. | |
| 1,726,012 | A | | 8/1929 | Bilz | |
| 1,754,568 | A | | 4/1930 | Nischan | |
| 2,448,817 | A | | 9/1948 | McArthur | |
| 2,536,452 | A | | 1/1951 | Leissler | |
| 2,608,253 | A | * | 8/1952 | Battles et al. | 100/257 |
| 2,634,987 | A | | 4/1953 | Palmer | |
| 2,735,489 | A | | 2/1956 | Fowler | |
| 2,808,108 | A | | 10/1957 | Pellegrino | |
| 2,991,601 | A | | 7/1961 | Glatter et al. | |
| 3,269,011 | A | * | 8/1966 | Herrstrum | 30/360 |
| 3,288,501 | A | | 11/1966 | Ross | |
| 3,335,627 | A | | 8/1967 | Smelts | |
| 3,425,219 | A | | 2/1969 | Oliver et al. | |
| 3,548,700 | A | | 12/1970 | Herzog | |
| 3,640,364 | A | * | 2/1972 | Utton | 192/98 |
| 3,935,771 | A | | 2/1976 | Cady, Jr. | |
| 4,403,417 | A | | 9/1983 | Wilson et al. | |
| 4,495,699 | A | * | 1/1985 | Oakes | 30/360 |
| 4,594,779 | A | | 6/1986 | Hagemeyer | |
| 4,720,219 | A | * | 1/1988 | Masonek | B23B 5/168 30/172 |
| 4,793,063 | A | * | 12/1988 | Ducret | 30/360 |
| 4,899,447 | A | * | 2/1990 | Adleman | 30/360 |

(Continued)

*Primary Examiner* — Gloria R Weeks
(74) *Attorney, Agent, or Firm* — Michael Best & Friedrich LLP

(57) ABSTRACT

A hand-held knockout punch driver for use with a punch and a die. The hand-held knockout punch driver having a body with a handle portion and a contact surface, a motor positioned within the body, a draw stud moveable with respect to the body, and a magnetic coupling member configured to releaseably couple the die to the contact surface of the body.

17 Claims, 12 Drawing Sheets

(56) References Cited

U.S. PATENT DOCUMENTS

| | | | | |
|---|---|---|---|---|
| 4,905,557 | A * | 3/1990 | Adleman | 83/681 |
| 4,975,001 | A | 12/1990 | Rabo et al. | |
| 5,013,193 | A * | 5/1991 | Rabo | B23B 5/168 30/500 |
| 5,020,407 | A | 6/1991 | Brinlee | |
| 5,056,391 | A | 10/1991 | Stewart | |
| 5,190,392 | A | 3/1993 | Parma et al. | |
| 5,271,303 | A | 12/1993 | Chatham | |
| 5,342,155 | A | 8/1994 | Harroun | |
| 5,405,347 | A | 4/1995 | Lee et al. | |
| 5,425,558 | A | 6/1995 | Dennany, Jr. | |
| 5,593,265 | A | 1/1997 | Kizer | |
| 5,626,433 | A | 5/1997 | Iwamoto | |
| 5,647,256 | A | 7/1997 | Schneider | |
| 5,833,383 | A | 11/1998 | Bauman | |
| 5,911,800 | A | 6/1999 | Roberts et al. | |
| 6,047,621 | A | 4/2000 | Dries et al. | |
| 6,126,359 | A | 10/2000 | Dittrich et al. | |
| 6,148,710 | A | 11/2000 | Pottorff | |
| 6,161,279 | A | 12/2000 | Suboski | |
| 6,209,208 | B1 | 4/2001 | Marinkovich et al. | |
| 6,279,445 | B1 | 8/2001 | Rosene et al. | |
| 6,305,889 | B1 | 10/2001 | Blessing et al. | |
| 6,367,362 | B1 * | 4/2002 | Brazell | B21D 28/243 83/518 |
| 6,485,218 | B1 | 11/2002 | Martinovsky | |
| 6,754,967 | B2 | 6/2004 | Lovell et al. | |
| 6,840,698 | B2 | 1/2005 | Cattaneo | |
| 6,860,670 | B2 | 3/2005 | Jeffries | |
| 6,877,927 | B2 | 4/2005 | Paulin et al. | |
| 6,953,197 | B2 | 10/2005 | Hartmann | |
| 7,090,700 | B2 | 8/2006 | Curtis | |
| 7,125,192 | B2 | 10/2006 | Yokota | |
| 7,316,404 | B1 | 1/2008 | Walker | |
| 7,698,979 | B2 | 4/2010 | Sugizaki et al. | |
| 7,726,554 | B2 | 6/2010 | Thielges et al. | |
| 7,927,036 | B2 | 4/2011 | Reasoner | |
| 7,980,781 | B2 | 7/2011 | Trice | |
| 8,007,196 | B2 | 8/2011 | Whitling et al. | |
| 8,327,745 | B2 | 12/2012 | Lee et al. | |
| 8,366,341 | B2 | 2/2013 | Bevirt | |
| 8,408,111 | B2 | 4/2013 | Johnston et al. | |
| 8,584,581 | B2 | 11/2013 | Curtin | |
| 8,657,594 | B2 | 2/2014 | Atagi et al. | |
| 8,714,065 | B2 | 5/2014 | Takahashi et al. | |
| 8,904,911 | B2 | 12/2014 | Nordin | |
| 2002/0002775 | A1 * | 1/2002 | Kimura | 30/362 |
| 2002/0007714 | A1 | 1/2002 | Ohtsuka et al. | |
| 2004/0200333 | A1 | 10/2004 | Seeley et al. | |
| 2008/0011135 | A1 * | 1/2008 | Ray | 83/55 |
| 2008/0092713 | A1 | 4/2008 | Takahashi et al. | |
| 2008/0210076 | A1 * | 9/2008 | Bublitz et al. | 83/613 |
| 2009/0110477 | A1 | 4/2009 | Seger | |
| 2009/0224534 | A1 | 9/2009 | Liu | |
| 2010/0031492 | A1 | 2/2010 | Lee et al. | |
| 2010/0107832 | A1 | 5/2010 | Johnston et al. | |
| 2010/0180744 | A1 | 7/2010 | Nordlin | |
| 2013/0305544 | A1 * | 11/2013 | Haase | B26F 1/386 30/360 |
| 2013/0333578 | A1 | 12/2013 | Lee et al. | |

* cited by examiner

HAND-HELD KNOCKOUT PUNCH DRIVER

CROSS-REFERENCE TO RELATED APPLICATIONS

This application claims the benefit of and priority to U.S. Provisional Patent Application No. 61/474,156 filed Apr. 11, 2011, the entire contents of which are hereby incorporated by reference.

BACKGROUND OF THE INVENTION

The present invention relates to knockout punches and, more particularly, to powered knockout drivers.

Knockout drivers are generally used in combination with a punch and die set to form apertures within sheet material, such as sheet steel and the like. The punching process is accomplished by providing a large force between the die and punch, causing the punch to pierce the sheet material and form the desired aperture. The force can be produced in a number of ways, such as manually, hydraulically, and the like. Typically, manual embodiments are limited by the size of hole they can create while most hydraulic powered systems can be bulky.

SUMMARY OF THE INVENTION

In some embodiments, the invention provides a hand-held knockout punch driver. The hand-held knockout punch driver including a punch, a die, a body having a handle portion and a contact surface, and a motor positioned within the body the motor being powered by a battery. The hand-held knockout punch driver also includes a draw stud moveable with respect to the body, the draw stud having one of the punch and the die coupled thereto, and a magnetic coupling member configured to releaseably couple the other of the die and the punch to the contact surface of the body.

In other embodiments, the invention provides a hand-held knockout punch driver having a body with a handle portion, a motor positioned within the body, the motor being powered by a battery, and a draw stud moveable with respect to the body, the draw stud having a first portion with a substantially D shaped cross-sectional shape and a second portion having a substantially circular cross-sectional shape.

In still other embodiments, the invention provides a hand-held knockout punch driver including a die, a punch, a body having a handle portion and a contact surface, and a draw stud moveable with respect to the body. Where the draw stud extends through the contact surface and where one of the die and the punch is coupled to the draw stud. The hand-held knockout punch driver also includes a coupling member to releaseably couple the other of the punch or the die to the contact surface.

DETAILED DESCRIPTION

Figure 1:
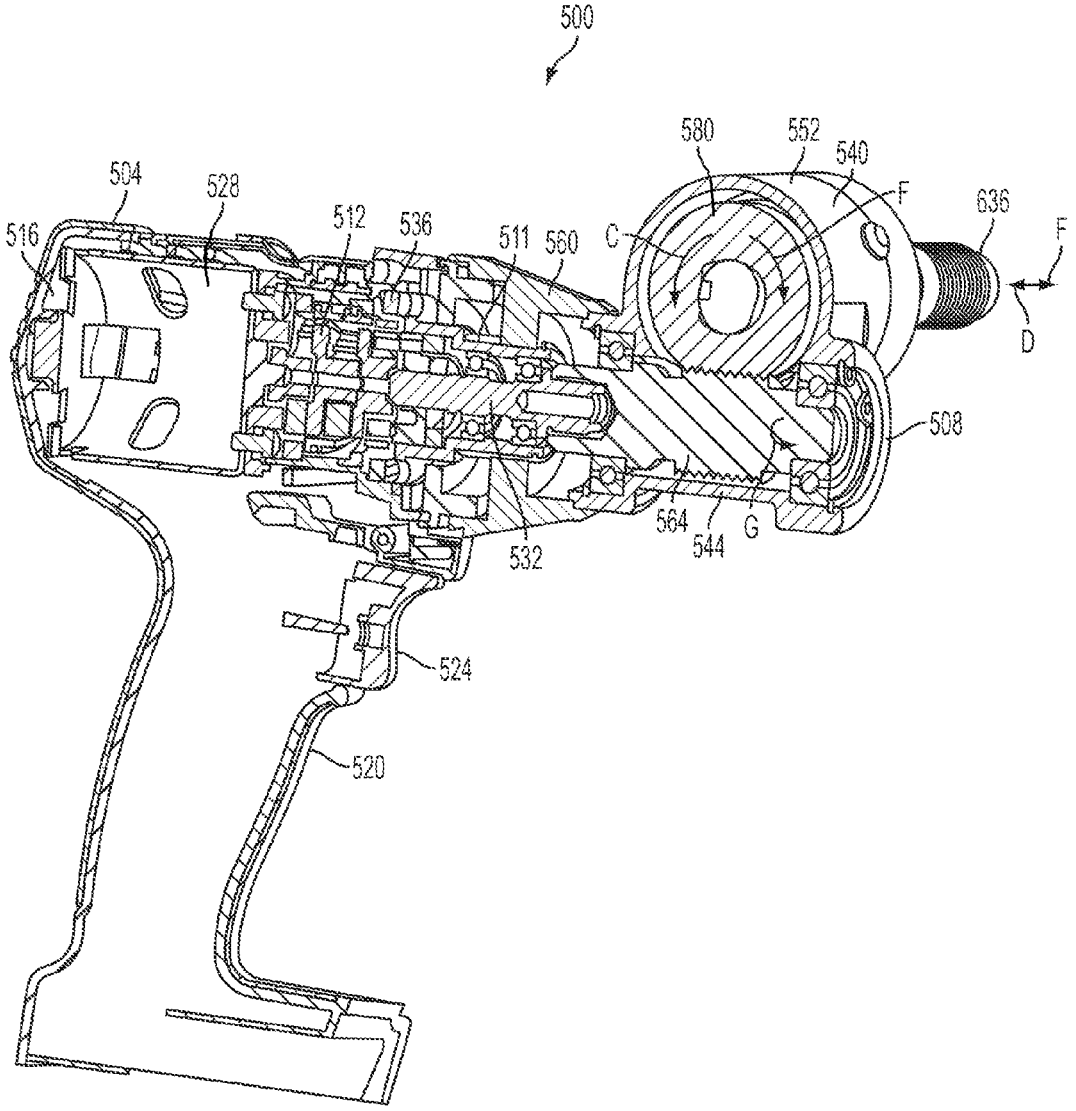
FIG. 1 is a section view of a knockout driver.
Figure 2:
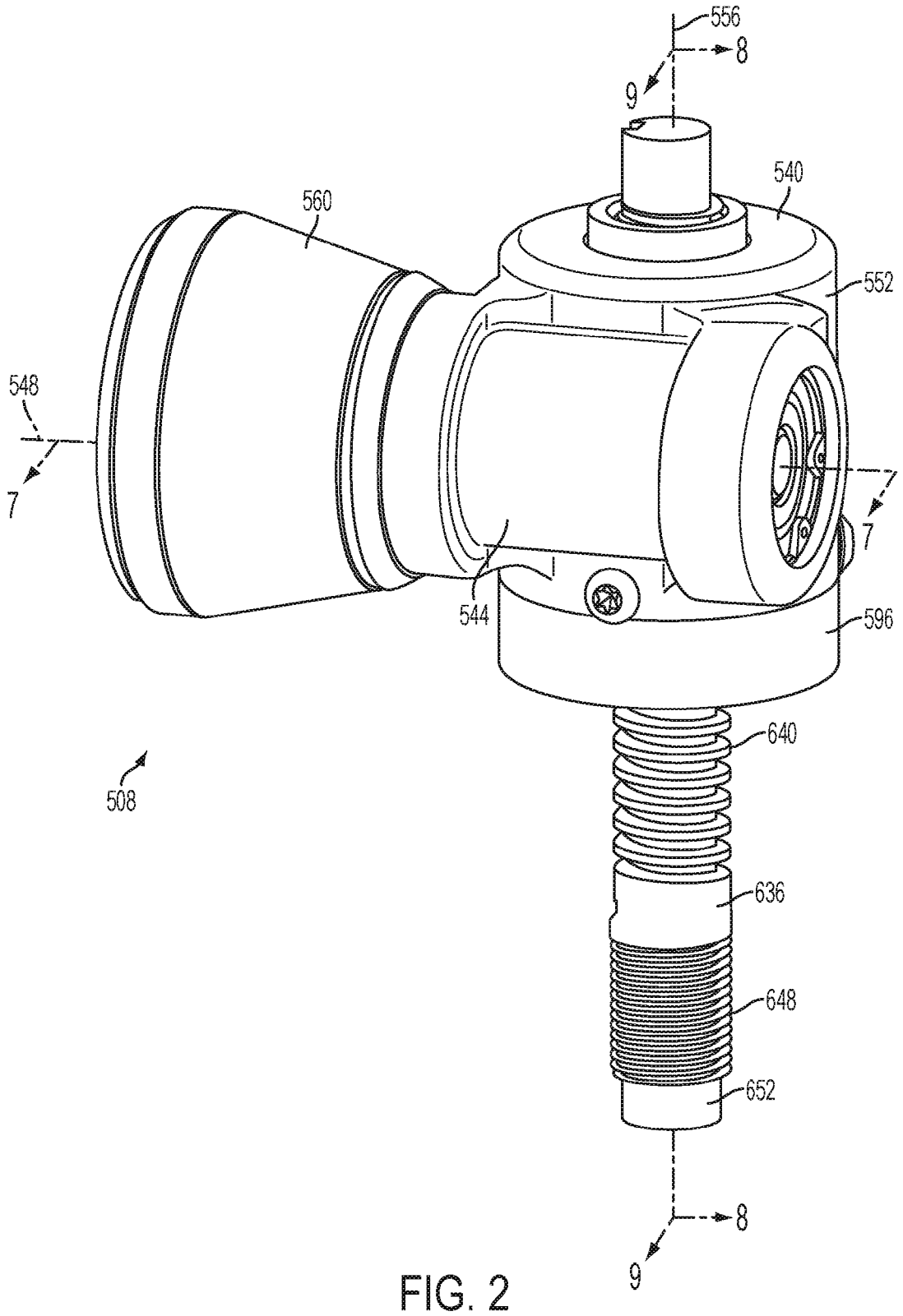
FIG. 2 is a perspective view of a head unit of the knockout driver shown in FIG. 1.
Figure 3:
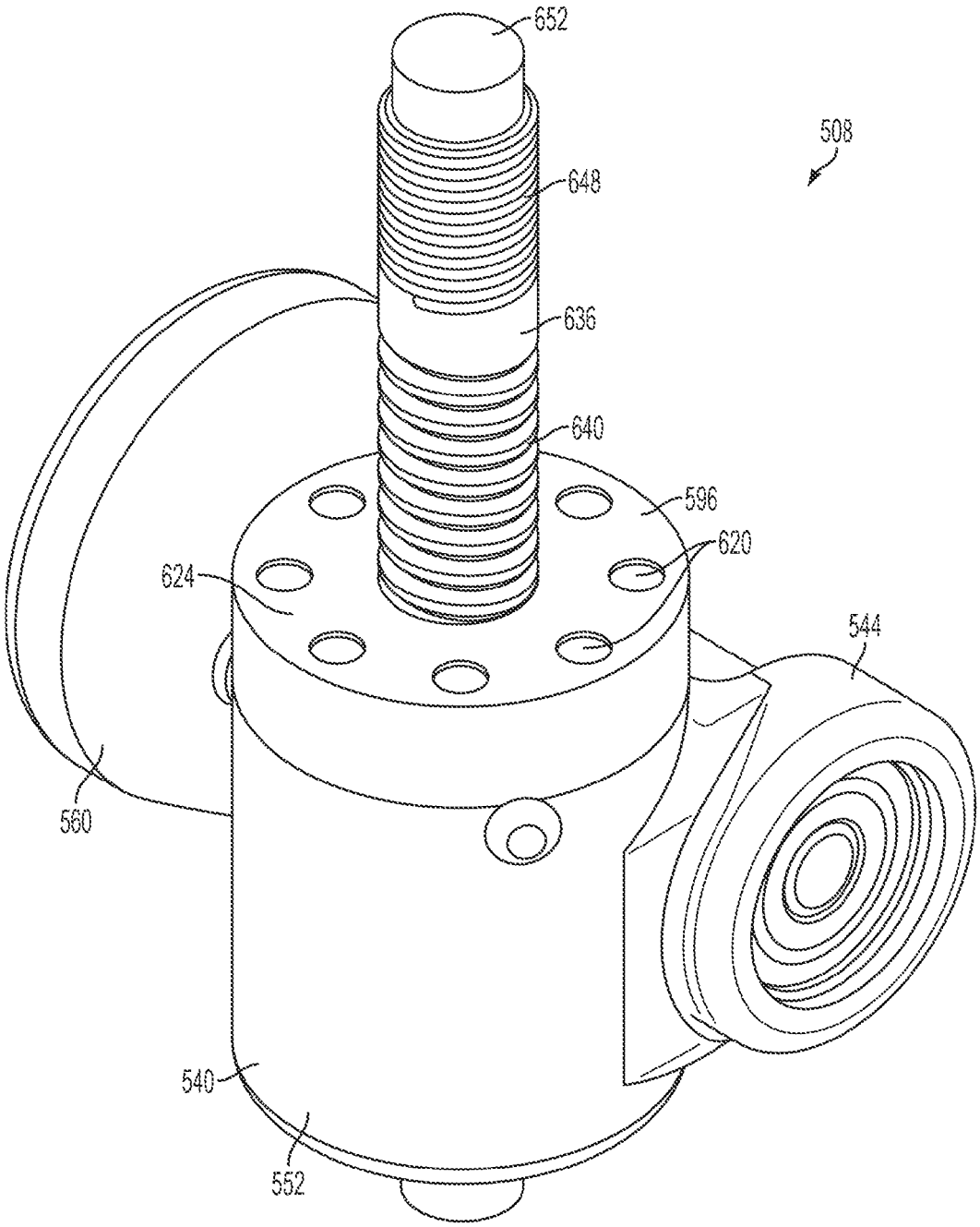
FIG. 3 is a bottom perspective view of the head unit shown in FIG. 2.
Figure 4:
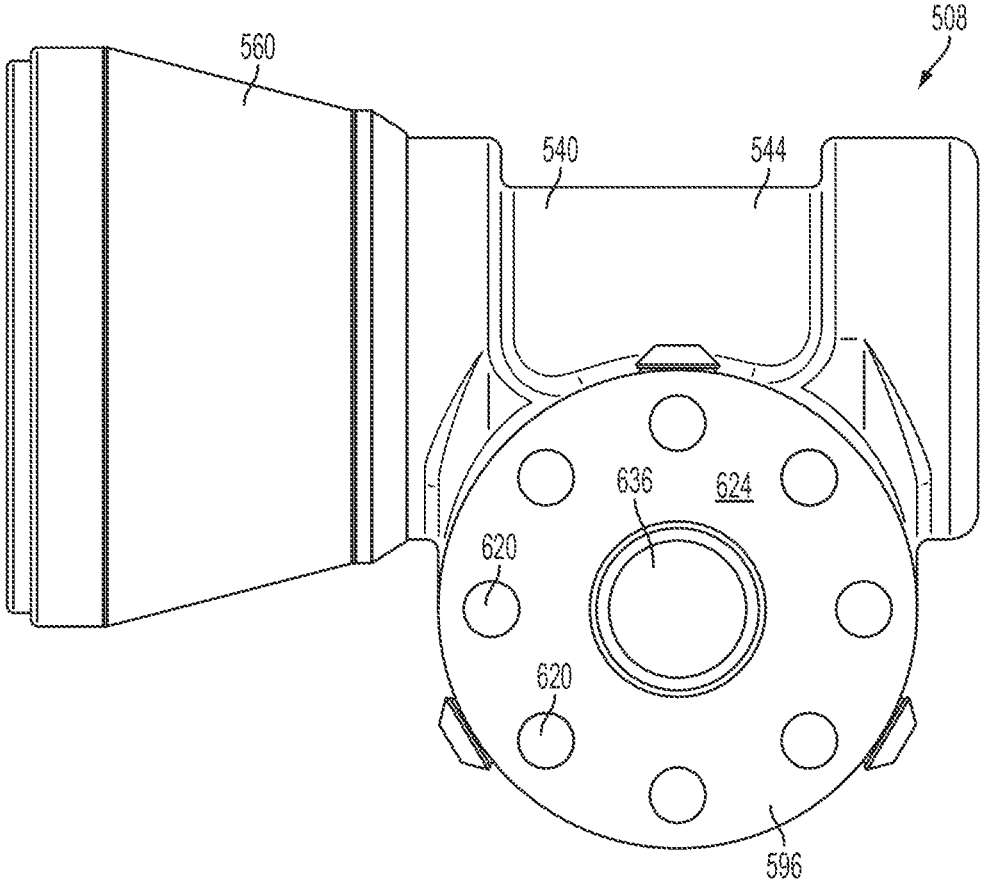
FIG. 4 is a bottom view of the head unit shown in FIG. 2.
Figure 5:
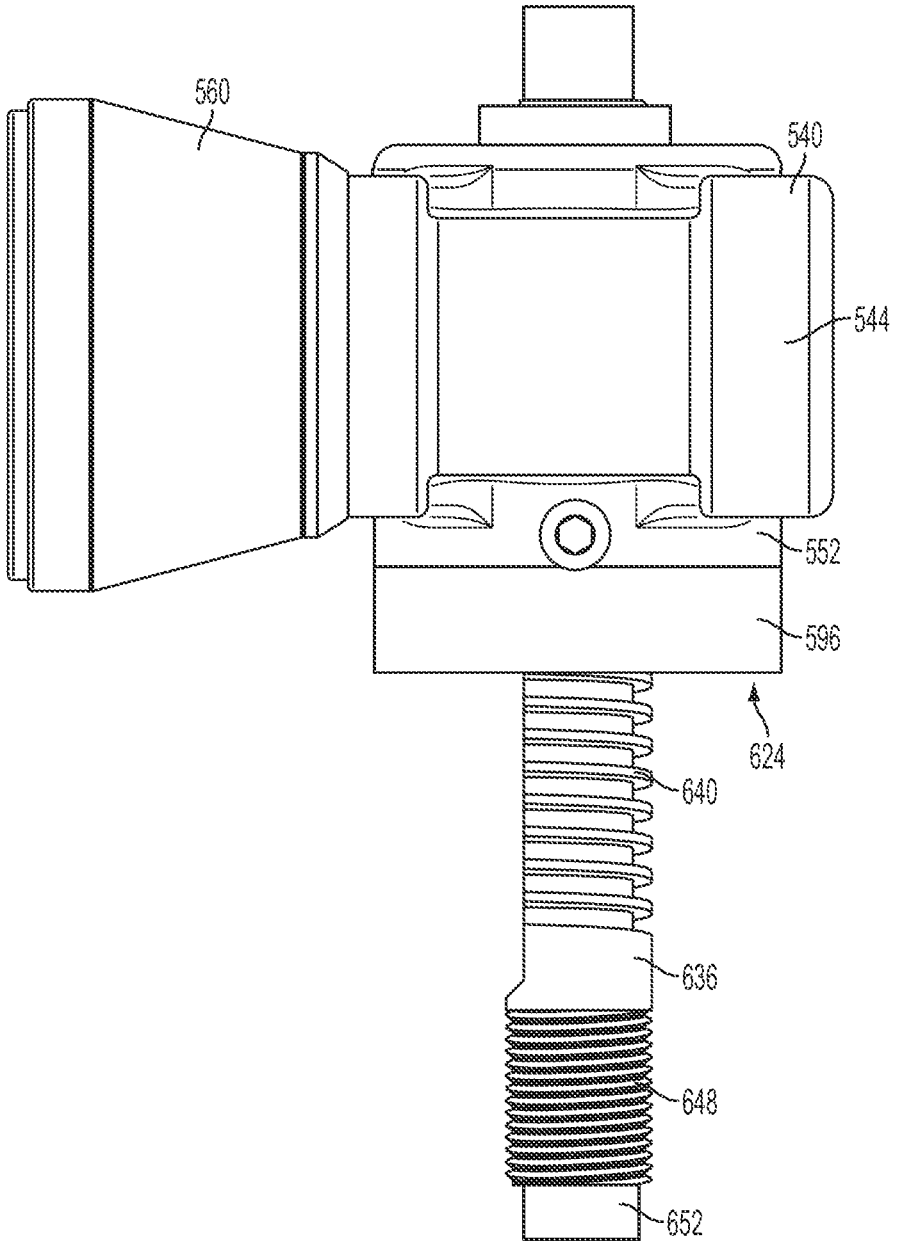
FIG. 5 is a front view of the head unit shown in FIG. 2.
Figure 6:
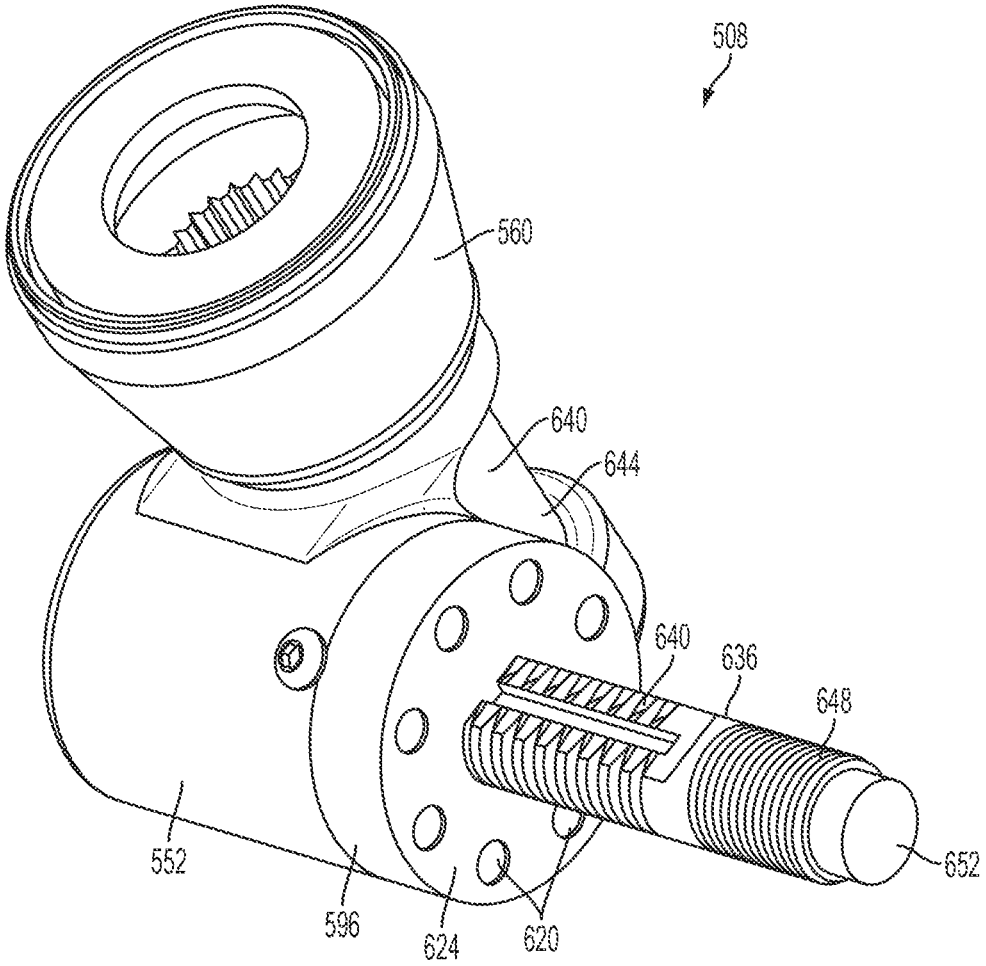
FIG. 6 is another perspective view of the head unit shown in FIG. 2.

Before any independent embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

FIGS. 1-10 illustrates a powered hand-held knockout driver 500 to be used in conjunction with a punch and die set to form apertures in sheet material (e.g., sheet steel and the like). The driver 500 includes a main housing 504, a head unit 508 coupled to the main housing 504, and a drive assembly 512 positioned within the main hosing 504 and operatively coupled to the head unit 508. In the illustrated embodiment, the main housing 504 is substantially similar in shape to the housing of a power drill. More specifically, the housing 504 includes a main chamber 516, configured to house elements of the drive assembly 512, and a handle portion 520, which extends from the main chamber 516 and provides an ergonomical place for the user to grasp the driver 500. The handle 520 also includes a trigger 524 configured to operate the driver 500.

Referring to FIG. 1, the drive assembly 512 of the driver 500 includes a motor 528, an output shaft 532, and a gear assembly 536 extending between and configured to transmit torque between the motor 528 and the output shaft 532. In the illustrated embodiment, the motor 528 is powered by an 18V rechargeable battery, however in further embodiments, the motor may be powered by a battery having a greater or lesser voltage, an AC design, pneumatic, or the like.

Figure 7:
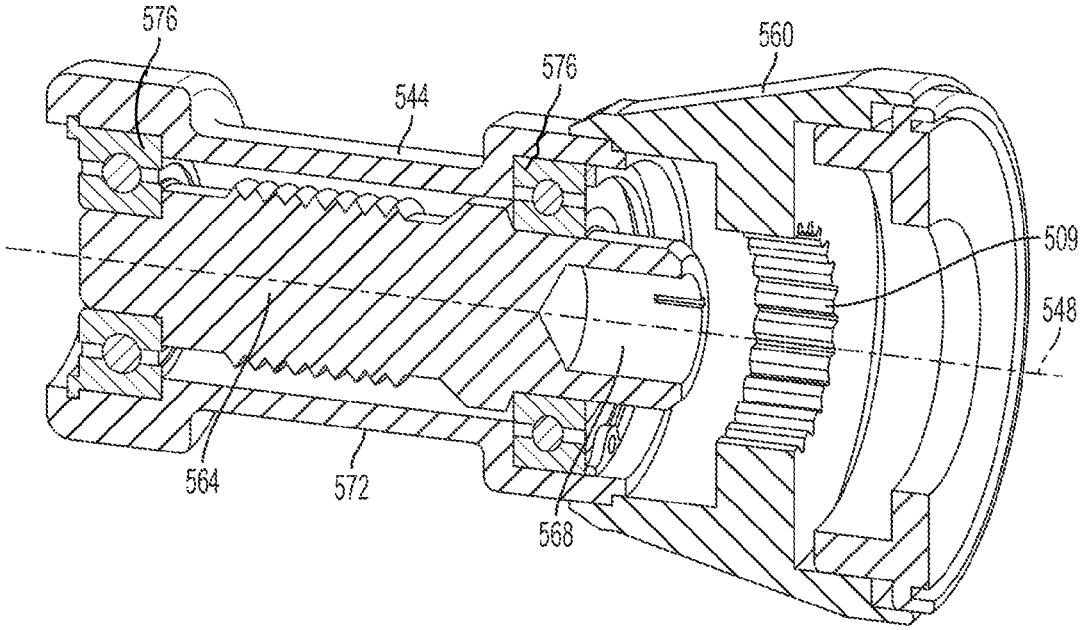
FIG. 7 is a section view taken along lines 7-7 of FIG. 2.
Figure 8:
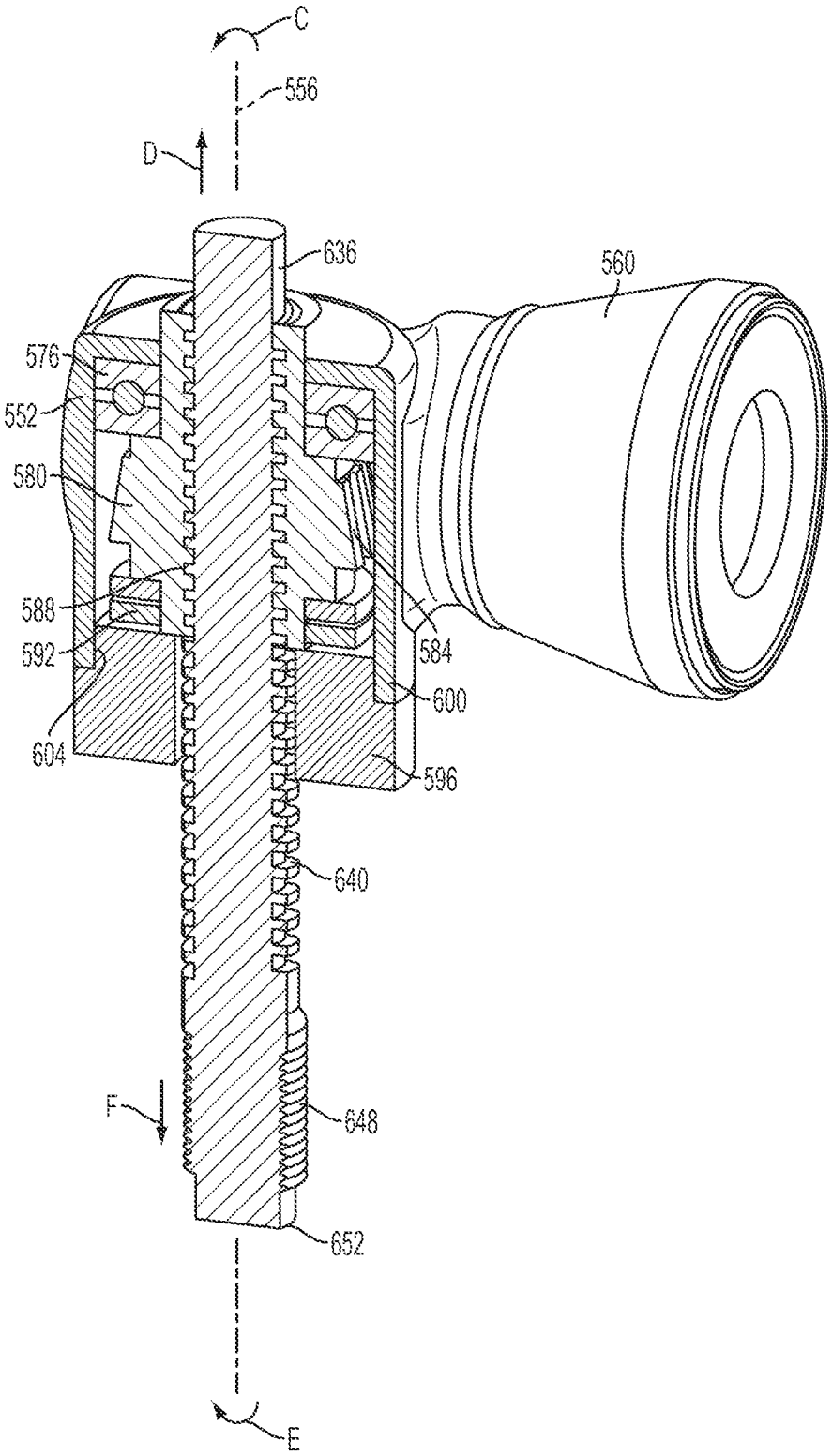
FIG. 8 is a section view taken along lines 8-8 of FIG. 2.
Figure 9:
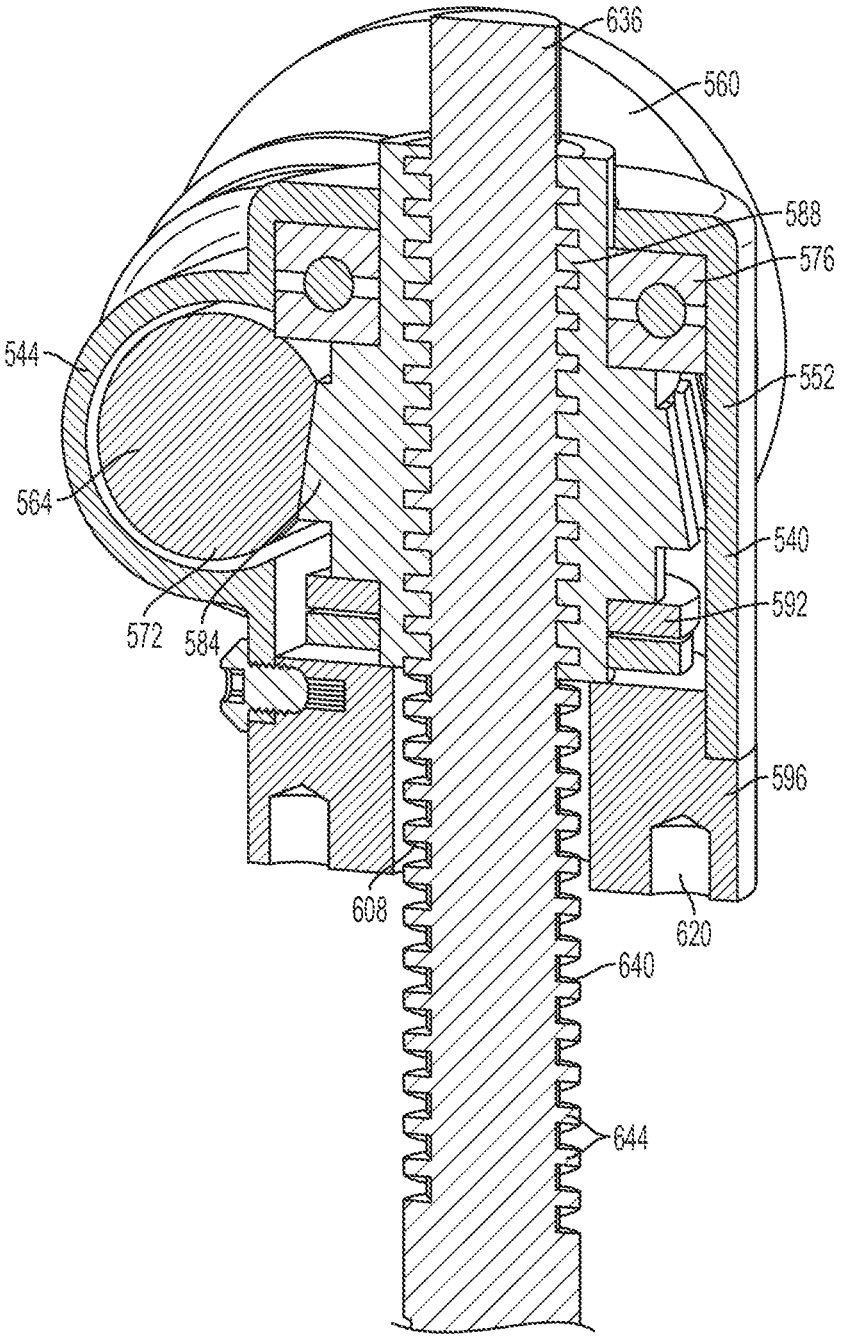
FIG. 9 is a section view taken along lines 9-9 of FIG. 2.
Figure 10A:
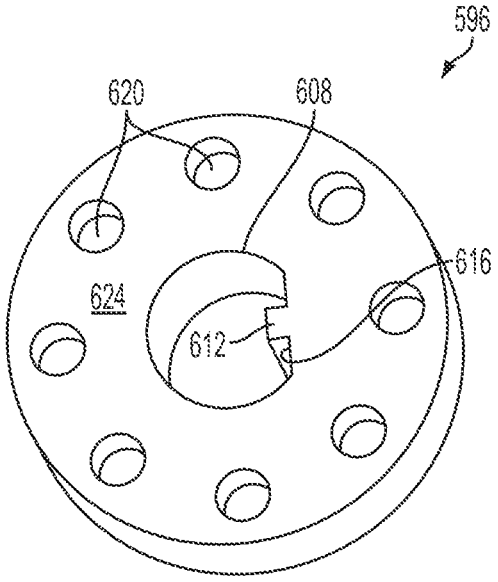
FIGS. 10*a* and 10*b* illustrate a cap of the head unit shown in FIG. 2.
Figure 10B:
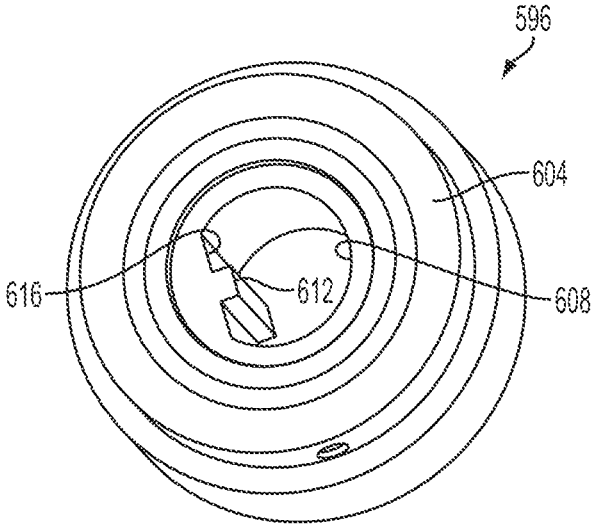

Referring to FIGS. 2-9, the head unit 508 of the driver 500 includes a body 540 having a first cylindrical portion 544 defining a first axis 548 and a second cylindrical portion 552, which extends substantially perpendicular to and slightly offset from the first cylindrical portion 544 to define a second axis 556. In the illustrated embodiment, interiors of the first and second cylindrical portions 544, 552 are open to and in communication with one another (FIG. 9).

The body 540 includes a collar 560 coupled to and extending from one end of the first cylindrical portion 544 to couple the head unit 508 to the main housing 504. In the illustrated embodiment, the collar 560 is adjustable between a first locked configuration, where the internal teeth 509 (FIG. 7) engage the external teeth 511 of the housing 504, and a second unlocked configuration, where the internal teeth 509 do not engage the external teeth 511. In the locked configuration, the body 540 of the head unit 508 is fixed with respect to the main housing 504. In the unlocked configuration, the body 540 is free to rotate about the first axis 548 with respect to the main housing 504, thereby allowing a user to adjust the driver 500 for use in difficult to reach or cramped spaces. In other embodiments, the collar 560 allows the head unit 508 to be removed from the main housing 504 for maintenance and the like. In still other embodiments, the collar 560 may serve as an adapter for installing the head unit 508 to various power tools (e.g., a drill, grinder, and the like).

Referring to FIG. 7, the head unit 508 includes an input shaft 564 positioned within and rotatable with respect to the first cylindrical portion 544 about the first axis 548. The input shaft 564 includes a first end 568 that engages the output shaft 532 of the drive assembly 512 and transmits torque therebetween. The input shaft 564 also includes a set of worm teeth 572 positioned proximate the axial center of the shaft 564. In the illustrated embodiment, the input shaft 564 is supported at both ends by a pair of bearings 576, which help reduce rotational friction within the assembly. In the illustrated embodiment, the first end 568 includes a keyway (FIG. 7) to transmit torque with the output shaft 532. However, in other embodiments the first end 568 of the input shaft 564 may include splines, or grooves to facilitate torque transmission with the output shaft 532.

Referring to FIG. 8, the head unit 508 also includes a worm wheel 580 positioned within and rotateable with respect to the second cylindrical portion 552 of the body 540 about the second axis 556. The worm wheel 580 includes a first set of gear teeth 584 extending radially outward from an external surface of the wheel 580 and a second set of gear teeth 588 extending radially inward from an internal surface of the wheel 580. When the driver 500 is assembled, the first set of gear teeth 584 mesh with the worm teeth 572 of the input shaft 564, and the second set of gear teeth 588 mesh with the teeth of a draw rod 636. In the illustrated embodiment, the worm wheel 580 is radially positioned within the second cylindrical portion 552 by a bearing 576 and axially positioned by a thrust bearing 592.

Referring to FIGS. 8-10*b*, the head unit 508 also includes a substantially cylindrical end cap 596 coupled to a bottom end 600 of the second cylindrical portion 552 of the body 540. The end cap 596 includes a mounting flange 604 extending axially from the cap 596 to be received within and co-axially align the cap 596 and the second cylindrical portion 552. The end cap 596 also defines a substantially "D" shaped aperture 608 co-axial the second axis 556 and extending therethrough. In the illustrated embodiment, the aperture includes a flat surface 616 and the cap 596 includes a protrusion 612, extending inwardly into the aperture 608 (FIG. 10*a*).

The end cap 596 includes a plurality of coupling members or magnets 620 embedded within and positioned evenly over a contact surface 624 of the end cap 596. During operation, the magnets 620 are configured to attract one of the die or punch against the contact surface 624. The contact surface 624 acts as an anvil against which the punch or die may rest to absorb the forces produced during the punching process.

Figure 11:
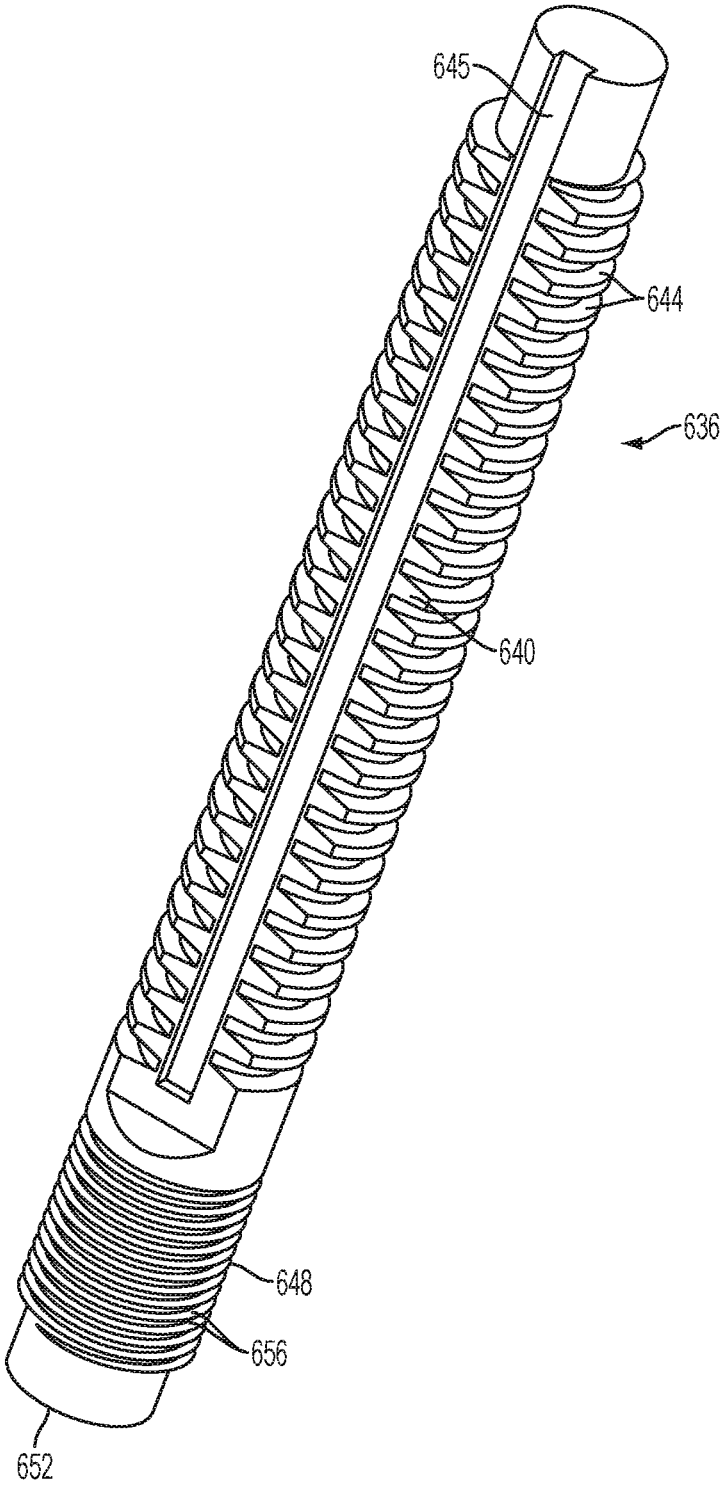
FIG. 11 illustrates a draw stud of the head unit shown in FIG. 2.

Referring to FIG. 11, the head unit 508 includes the draw rod 636, which is threadably coupled to the worm wheel 580 and moveable axially along the second axis 556. The draw rod 636 includes a first portion 640 having a substantially "D" shaped cross-section that is configured to be received and move within the aperture 608 of the end cap 596. In the illustrated embodiment, the first portion 640 is shaped such that it cannot rotate within the aperture 608, and is thereby restricted to axial movement only. The first portion 640 also includes a first set of threads 644 extending an axial length of the first portion 640 over a portion of the circumference. In the illustrated embodiment, the first set of threads 644 mesh with the second set of gear teeth 588 of the worm wheel 580. The first portion 640 also includes an axially extending channel 645 configured to receive the protrusion 612 therein.

During operation, the worm wheel 580 is driven by the input shaft 564, via the gear teeth 572, 584, once the motor 528 is actuated. Rotation of the worm wheel 580 about the second axis 556 causes the draw rod 636 to move axially within the aperture 608. More specifically, when the worm wheel 580 rotates in a first direction C, the draw rod 636 moves in a first direction D, and when the worm wheel 680 rotates in a second direction E, opposite the first direction C, the draw rod 636 moves in a second direction F opposite the first direction D (FIG. 8).

The draw rod 636 also includes a second portion 648 proximate the distal end 652 that has a substantially circular cross-section forming a second set of threads 656. When assembled, one of the punch or the die (not shown) is threadably coupled to the second portion 648 of the draw rod 636.

Figure 12:
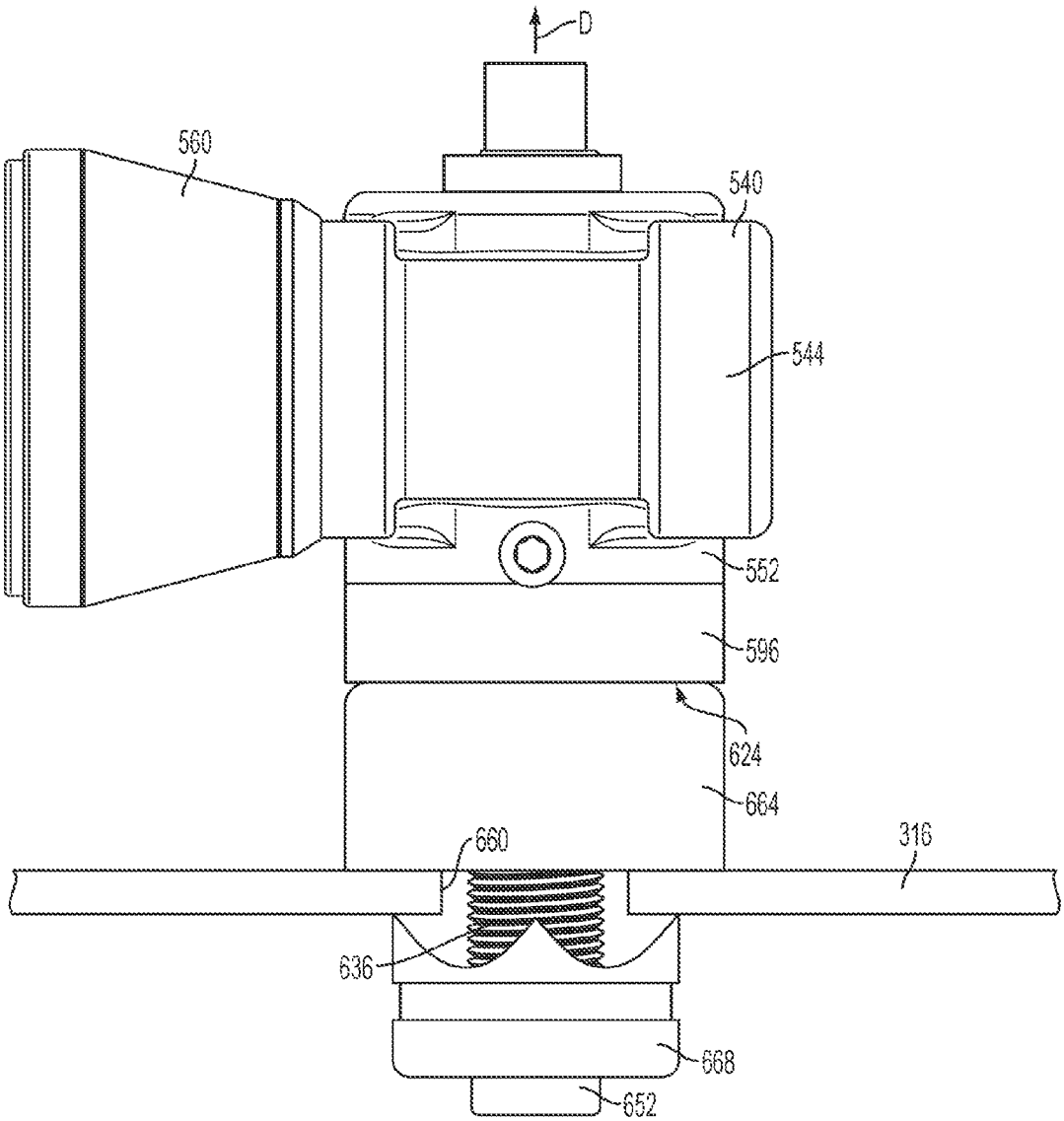
FIG. 12 illustrates a planar view of the head unit of FIG. 2 assembled with a punch, a die, and sheet material.

Illustrated in FIG. 12, to punch a hole in sheet material using knockout driver 500, a preliminary aperture 660 is first drilled into the sheet material 316 proximate a center of the hole to be punched. Insert the distal end 652 of the draw rod 636 through a die 664, and move the die 664 along the draw rod 636 until it contacts and is retained against the contact surface 624 by the one or more magnets 620. Insert the distal end 652 of the draw rod 636 through the aperture 660 in the sheet material, and threadably couple the punch 668 to the draw rod 636. The cutting surface of punch 668 should face the material to be cut.

With the setup complete, the user activates the driver 500 by depressing the trigger 524, which causes the motor 528 to rotate. As the motor 528 rotates, torque is transferred via the gear set 536 to the output shaft 532, which in turn rotates the input shaft 564 of the head unit 508 in a first direction G (FIG. 1). The input shaft 564 then rotates the worm wheel 580 in a first direction C, which in turn causes the draw rod 636 to move in the first direction D (described above) and imparts tension on the draw rod 636.

As the motor 528 continues to provide torque, the punch is drawn toward the die until enough force is created to physically cut (e.g., punch) the sheet material and create the desired aperture.

The system may then be reset by reversing the rotation of the motor 528, causing the input shaft 564, worm wheel 580, and draw stud 636 to all reverse direction, which displaces the punch away from the die.

Although not shown in the illustrated embodiment, the driver 500 may also include a clutch, or other form of disengagement to operatively separate the head unit 508 from the drive assembly 512.

In some alternate embodiments, the knockout driver embodiment can be modified to be a push driver, instead of a pull, as shown.

Although the invention has been described in detail with reference to certain preferred embodiments, variations and modifications exist within the scope and spirit of one or more independent aspects of the invention as described.

The invention claimed is:

1. A hand-held knockout punch driver comprising:

a housing having a handle portion;

a motor positioned within the housing, the motor being powered by a battery;

a draw stud moveable with respect to the housing, the draw stud having a first portion with a substantially D shaped cross-sectional shape and a second portion having a substantially circular cross-sectional shape; and an end cap coupled to the housing having an aperture with a substantially D shaped cross-sectional shape corresponding to the D shaped cross-sectional shape of the first potion of the draw stud, wherein the first portion of the draw stud having the substantially D shaped cross-sectional shape extends through the aperture in the end cap.

2. The hand-held knockout punch driver of claim 1, further comprising:

a punch;

a die;

a body coupled to the housing and having a contact surface;

wherein the draw stud has the punch or the die coupled thereto; and a magnetic coupling member configured to releaseably couple the other of the die or the punch to the contact surface of the body.

3. The hand-held knockout punch driver of claim 2, wherein the coupling member includes a plurality of magnets.

4. The hand-held knockout punch driver of claim 3, wherein the magnets are equally spaced over the contact surface.

5. The hand-held knockout punch driver of claim 2, wherein the magnetic coupling member is positioned in the body.

6. The hand-held knockout punch driver of claim 2, wherein the magnetic coupling member is positioned proximate the contact surface.

7. The hand-held knockout punch driver of claim 2, wherein the draw stud extends through the contact surface.

8. The hand-held knockout punch driver of claim 2, further comprising:

a worm gear rotatable by the motor;

a worm wheel rotateably mounted within the body and driven by the worm gear, and wherein the draw stud threadably engages the worm wheel.

9. The hand-held knockout punch driver of claim 8, wherein the draw stud extends through the contact surface.

10. The hand-held knockout punch driver of claim 2, wherein the end cap is coupled to the body and at least partially defines the contact surface.

11. The hand-held knockout punch driver of claim 10, wherein the magnetic coupling member is contained within the end cap.

12. The hand-held knockout punch driver of claim 1, wherein the first portion includes a first set of threads and the second portion includes a second set of threads.

13. The hand-held knockout driver of claim 12, wherein the first set of threads is different from the second set of threads.

14. The hand-held knockout punch driver of claim 1, wherein the first portion of the draw stud defines an axially extending slot.

15. The hand-held knockout punch driver of claim 1, wherein the first portion of the draw stud includes a first set of threads formed on an exterior of the draw stud on the D shaped cross-sectional shape, and wherein the second portion of the draw stud includes a second set of threads on the substantially circular cross-sectional shape.

16. The hand-held knockout punch driver of claim 15, further comprising:

a worm gear rotatable by the motor;

a worm wheel having a first set of gear teeth on an outer periphery thereof engaged with the worm gear, and a second set of gear teeth on an inner periphery thereof engaged with the first set of threads on the draw stud.

17. The hand-held knockout punch driver of claim 1, wherein the complementary D shaped cross-sectional shapes of the first portion of the draw stud and the aperture in the end cap, respectively, rotationally constrain the draw stud to the end cap.

* * * * *